US005101697A

United States Patent [19]

Fishback

[11] Patent Number: 5,101,697

[45] Date of Patent: Apr. 7, 1992

[54] DRYWALL SCREW DISPENSING AND DRIVING GUN

[75] Inventor: Gary M. Fishback, Santa Barbara, Calif.

[73] Assignee: Plenum Corporation, Santa Barbara, Calif.

[21] Appl. No.: 499,062

[22] Filed: Mar. 26, 1990

[51] Int. Cl.[5] ..... B25B 23/04

[52] U.S. Cl. ..... 81/434; 81/433

[58] Field of Search ..... 81/57.37, 431, 433, 81/434, 435

[56] References Cited

U.S. PATENT DOCUMENTS

| | | | |
|---|---|---|---|
| 2,707,277 | 5/1955 | Aldrich . | |
| 2,740,438 | 4/1956 | Austin | 81/433 |
| 2,770,269 | 11/1956 | Austin | 81/433 |
| 2,878,700 | 3/1959 | Reynolds . | |
| 2,927,491 | 3/1960 | Bochman, Jr. . | |
| 2,931,038 | 4/1960 | Wandel . | |
| 3,554,246 | 1/1971 | Halstead | 81/434 |
| 3,656,520 | 4/1972 | Caffa . | |
| 3,742,577 | 7/1973 | Buttriss . | |
| 3,757,407 | 9/1973 | Bomar . | |
| 3,837,555 | 9/1974 | Green . | |
| 3,891,014 | 6/1975 | Gunn | 81/57.37 |
| 4,428,261 | 1/1984 | Takatsu et al. | 81/434 |
| 4,581,964 | 4/1986 | Takatsuru . | |
| 4,778,094 | 10/1988 | Fishback . | |

*Primary Examiner*—D. S. Meislin

*Attorney, Agent, or Firm*—Wood, Herron & Evans

[57] ABSTRACT

A power driven electric reversible variable speed screwdriver is provided with a collated screwstrip feeder having a barrel which slides axially with respect to the blade and housing of a power screwdriver gun, is rotatably axially supported on the tool head of the gun in axial alignment with the gun blade, is locked by structure on the housing against rotation on the tool head. The orifice of the barrel is placeable in abutment with a sheet of drywall material to be fastened as the blade and gun housing reciprocates from an extended position relative to the barrel, at which a screw is fed through an opening in the barrel side into the barrel bore, to a retracted position relative to the barrel, at which the tip of the blade extends to an position beyond the barrel orifice to a position determined by rotary adjustment of a link connected to the tool head. The barrel and blade are selectively latchable in the retracted position to permit the screwdriver to be used in uncollated, single screw applications. The feeder includes a fixedly attached magazine or, alternatively, a guide for a remotely supplied screw strip, and, optionally, a cut-off for interconnecting strip material.

17 Claims, 5 Drawing Sheets

DRYWALL SCREW DISPENSING AND DRIVING GUN

The present invention relates to automatic or sequentially fed fastening devices and, more particularly, to power screwdrivers for use in securing building materials such as drywall to structural framework in building construction.

BACKGROUND OF THE INVENTION

The need for efficient and effective tools for the installation of building materials such as drywall, the need for rapidly and sequentially feeding fastening devices from a supply to such tools, and the need for properly recessing the fasteners in the surface of the building materials, have been discussed in my issued U.S. Pat. No. 4,778,094 entitled NAIL AND DIMPLER DRIVING APPARATUS FOR NAILING GUN, hereby expressly incorporated herein by reference. In that patent, I taught the securing of material such as drywall with fasteners such as drywall nails with a sequentially fed gun which provides dimpling capabilities for recessing the heads of the fastening devices. Sequentially fed fastening devices such as nailing guns are commonly referred to in the industry as "collated" fastener guns.

The construction industry, particularly in the United States, has exhibited an increased desire for securing building materials to one another by utilizing the holding power of screws, or fastening devices which are inserted into the materials with a rotational motion, to materials, as for example, sheet materials such drywall, to framing and other members in building construction. Screws usually are best installed by imparting a forward driving force or motion against a screw head at one end of the screw to thrust a point at the other end of the screw into the materials being fastened. Coupled with this forward force or motion is a rotational force or motion which cooperates with a helical thread on the screw to drive the screw into the materials and to draw and hold the materials together. The fastening and holding function of screws so driven is generally regarded in the construction industry as superior to the fastening and holding function performed by impact or impulse driven fasteners such as nails or staples. In addition, the head depth of a fastener, or the recessing into the material of the head of the fastener, which is important in installing drywall and other building materials, can be more precisely controlled with a threaded screw than with the impact or impulse driven fastener.

In the prior art, the installation of screws had, for many years, been performed by hand with the use of conventional screwdrivers. This slow, labor intensive process rendered the use of screws in building construction, particularly for installation of drywall and other sheet materials, too time consuming and expensive to be practical. The practical use of screws for such purposes in building construction has been enhanced by the development of power driven screwdrivers. In the use of such screwdrivers in building construction, supplying the screws to be driven by the power tool has, for the most part at least, been done by hand by the operator or user of the tool.

Efficient and effective high speed devices for automatically supplying screws to power screwdrivers, that is, power screwdrivers with collated screw feeds, have not existed in the prior art. Thus, while the development of power screwdrivers has facilitated the practical use of screws in some phases of building construction, such tools have not been sufficiently effective to provide reliable high speed use of screws so as to render their use in the installation of materials such as drywall as economical as is desired.

Furthermore, there is and will continue to be a need in the building construction industry to insert, tighten, or remove individual screws in the performance of a wide variety of small or miscellaneous tasks. The availability of power screwdrivers for such purposes will continue to be an important requirement, since any installation of almost any screw by hand is an unduly slow and tiring process.

Furthermore, when screws are installed with power screw drivers, upon installation, they frequently require additional tightening and adjustment. Accordingly, there and will continue to be a constant need to have readily on hand at a construction site a power screwdriver which is capable of driving screws which are already set in the material to, for example, remove or tighten such screws, or to drive individual screws which may be supplied in varying sizes by the manual selection of the construction worker.

Accordingly, there is a need to provide a power driven screwdriver which is efficient and effective to satisfy the needs of the construction industry, particularly in fastening materials such as drywall to structural members in building construction.

SUMMARY OF THE INVENTION

It is a primary objective of the present invention to provide a power driven collated screwdriver which is efficient and effective to satisfy the needs of the construction industry, particularly in fastening materials such as drywall to structural members in building construction.

It is a more particular objective of the present invention to provide a power driven screwdriver with automatic sequential feed of the screws while providing for alternative use of the power screwdriver for single screw or manually fed applications.

According to the principles of the present invention, there is provided a power driven screwdriver with a feeder for automatically supplying screws sequentially into the path of the screwdriver blade in synchronism with the advancement and retraction of the blade toward and away from the material being fastened. The feeder preferably supplies screws sequentially from a collated web or strip of screws which may be of a type particularly suited for drywall or other specific application.

According to certain principles of the present invention, the feeder and related assembly is attachable and removable from an assembly which may function as a power screwdriver for driving individually or hand fed screws, and, when so attached, may be selectively activated for sequential automatic feed of the screws or deactivated to permit use of the screwdriver in a single screw application mode. Preferably, the feeder assembly is attachable to and removable from, a power screwdriver assembly which will otherwise function as a power screwdriver gun for inserting, tightening or removing individual screws.

According to the preferred embodiment of the present invention, a power driven screwdriver assembly is provided which has a screw driver blade which engages is engaged by a clutch when the operator applies force to the gun handle, causing the blade to engage and then rotate a screw to advance the screw being rotated into the material being fastened. In combination with the screwdriver assembly, a screw feed assembly is provided which sequentially places screws from a collated strip into position between the tip of the screw driver blade and the material, allowing the operator to otherwise operate the screwdriver as it would be operated in installing individual screws, that is, by pushing the gun toward the material to facilitate the advancement of the screw into the material as the screw is being rotated by the power driven blade of the gun.

The feed assembly of the preferred embodiment is mounted to reciprocate axially with respect to the gun. As the front surface of the feeder barrel is placed against the drywall or other sheet material being fastened, it remains stationery as the gun is advanced to drive the screw. A slide block is fixed to the gun with the feeder slidably mounted thereon so as to slide between an extended position, at which a new screw is fed from a collated strip to the barrel in axial alignment with the blade of the screwdriver, and a retracted position at which the barrel surrounds the blade as the blade projects therethrough to drive the screw head to a position flush with, or slightly below, the surface of the drywall material being fastened.

To allow use of the gun as a single screwdriver, the feeder is lockable in the retracted position so that individual screws may be tightened or loosened by use of the blade. Release of a latching mechanism allows the feeder to be instantly returned to the condition of a functioning collated screw feeding device.

Positive and reliable alignment of the feeder is maintained by provision of a mounting unit by which the feed assembly attaches to, and is rotatably supported on, the tool head of the screwdriver gun. The alignment unit supports and aligns the feeder assembly and has the capability of adjusting the blade depth of the screwdriver to recess the screw heads in the sheet material whether the screws are being automatically fed or driven individually by the gun. Bracket structure attachable to the tool housing locks the feeder assembly against rotation on the tool head.

The feeder provided by the present invention, in its preferred embodiment, rests against the surface of the material being fastened during the screwdriving stroke in which the screwdriver gun moves toward the surface and then retracts. A magazine fixed to the barrel remains stationary with respect to the material as the screw is being driven, thus maintaining the inertia of the parts in motion at a minimum. The screws being fed to the bore of the barrel are advanced simultaneously as part of an interconnected strip easily replaced in the magazine.

The strip may be formed by interconnected sections of webbing which are separated from the screws by a cutting edge on a feeder support block and discarded through an opening in top of the barrel. In one alternative embodiment, the magazine is replaced with a guide slot in the barrel into which the interconnected strip of screws is drawn by the feeder. The strip may be supplied from magazine attached to the feeder, from a roll or other form of interconnected strip carried on the person of the operator, or from a container which is stationary at the job site, such as a box or roll dispenser on the floor.

The present invention provides a power driven collated screwdriver which is efficient and effective to satisfy the needs of the construction industry in fastening materials such as drywall to structural members in building construction.

The various features of the preferred embodiments of the invention provide a power driven screwdriver with automatic sequential, or collated, feed of the screws while providing for alternative use of the power screwdriver for single screw or manually fed applications. Providing for the conversion of a single tool from an automatic feed power tool to a single fastener driving power tool, is fast and easy to achieve, and overcomes the need to also supply a power tool on a job site for inserting, tightening or removing individual screws.

Furthermore, with the preferred embodiment of the invention, the collated screw feed assembly can be supplied as an attachment to a power screwdriver designed for single screw application and high quantity production.

These and other objectives and advantages of the present invention will be more readily apparent from the following detailed description of the drawings in which:

DESCRIPTION OF THE DRAWINGS

FIG. 5A is a cross sectional view taken along the line 5A—5A of FIG. 4.

Referring to FIG. 1, a drywall screw dispensing and driving gun lo according one preferred embodiment of the present invention is illustrated. The gun 10 includes two assemblies, a power driven screwdriver assembly 11 and a screw supply assembly 12. The screwdriver assembly 11 may be any of a number of power driven screwdrivers but is preferably a commercial duty, electric, hand-held, gun type, reversible, motor driven, variable speed screwdriver such as, for example, a Hilti® Kwik Driver 4000 manufactured by Hilti Inc. of Tulsa, Oklahoma.

Figure 1:
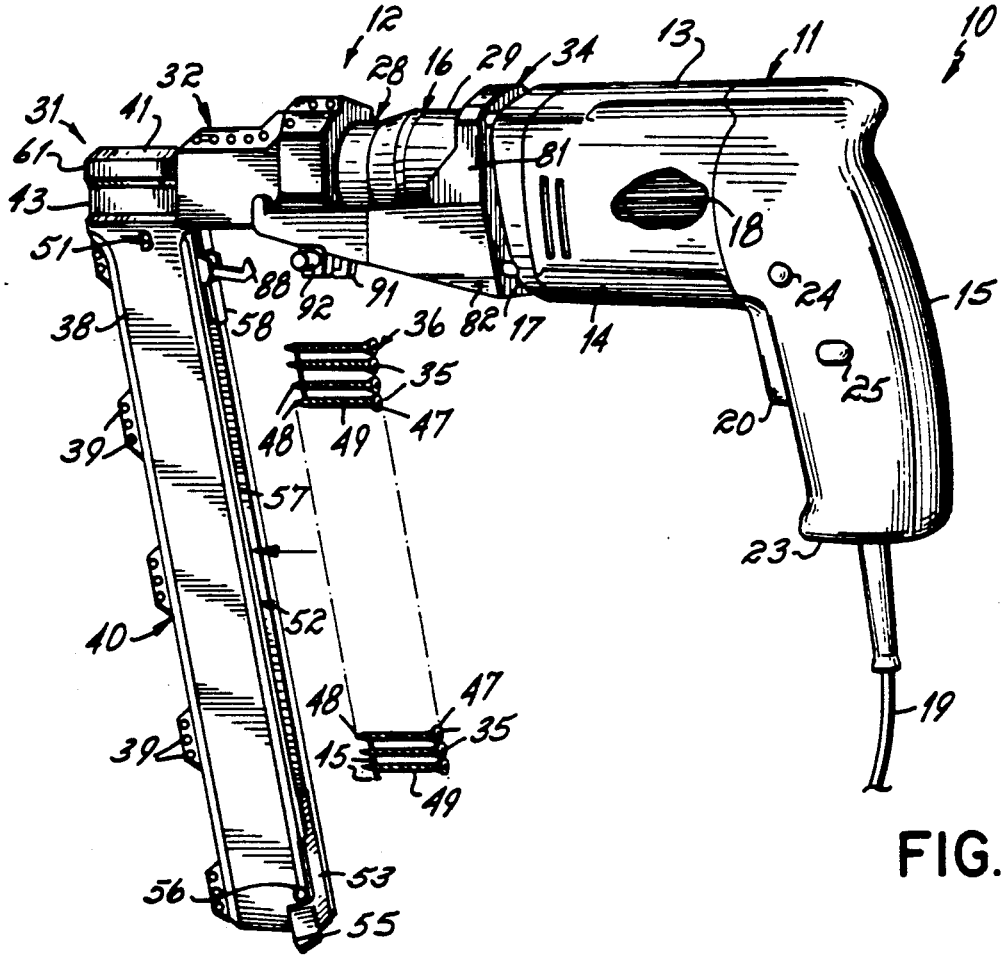
FIG. 1 is a perspective view of one embodiment of an automatic feed drywall screwdriver according to principles of the present invention.
Figure 2:
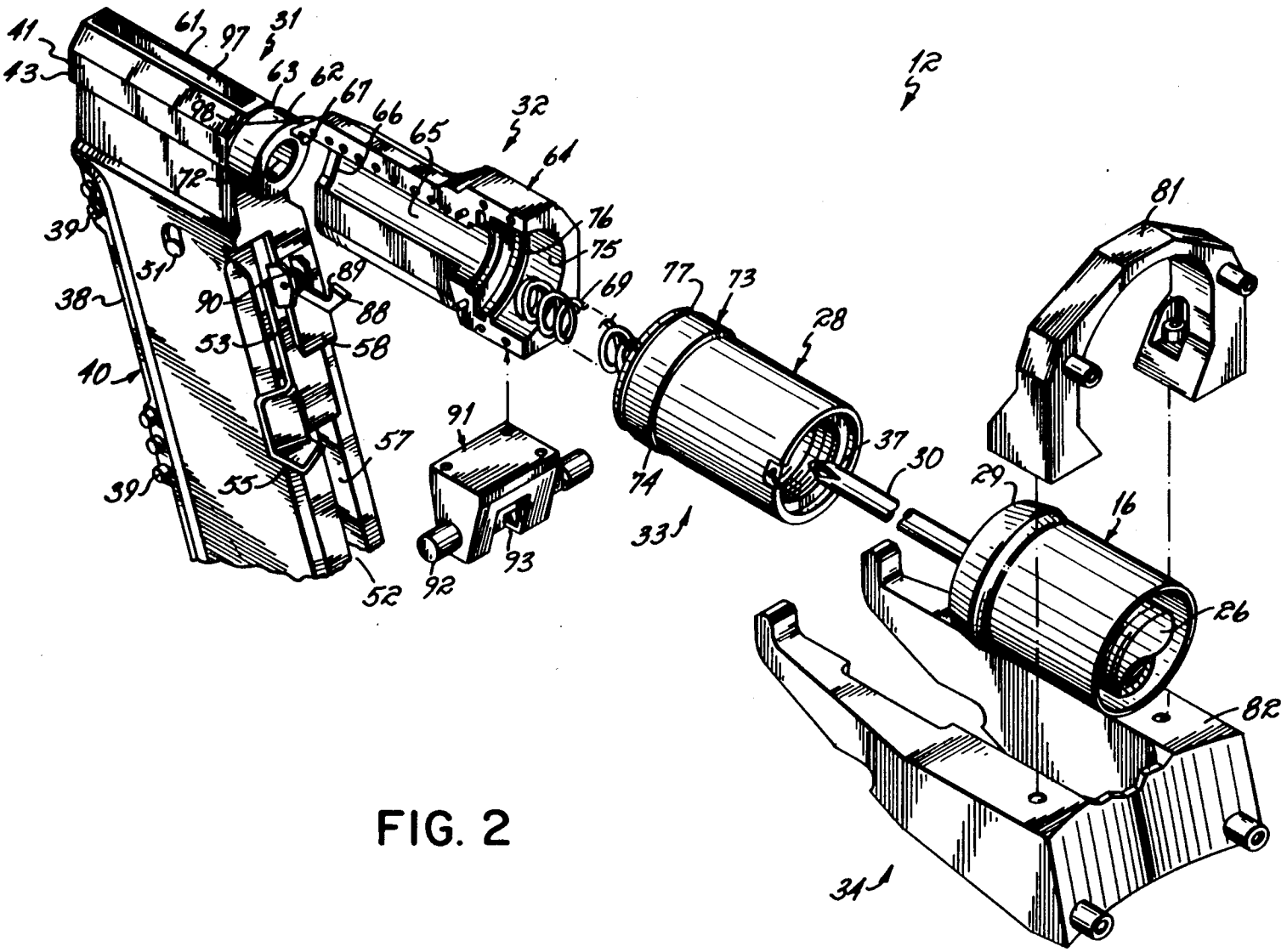
FIG. 2 is a perspective exploded partially cut-away view of the embodiment of the drywall screwdriver of FIG. 1, with the slide of the magazine in a released and upper position.

The screwdriver assembly 11 includes a plastic housing 13 having a body portion 14 and a handle portion 15 of a pistol grip type, and tool head 6 (FIGS. 1 and 4) supported at the front end 17 of the body 14 of the housing 13. The housing 13 encloses within it a variable speed, reversible electric motor is (see FIG. 1). The screwdriver assembly 11 has a power cord 19 electrically connected to the motor 18 through a variable speed control operated by a trigger 20 which is either slidably or pivotally mounted to the handle 15 of the housing 13 so as to be actuatable with the index finger of hand of a user which is holding the gun 10 for use. The cord 19 is physically connected to the screwdriver 11 at the butt end 23 of the handle 15 and is electrically connectable to a source of electrical power, typically a conventional 115 VAC power source. The screwdriver 11 has a direction reversing two-way pushbutton 24 slidably mounted through the handle 15 and linked in a conventional manner so as to provide direction reversal control of the drive of the motor 18. The screwdriver 11 also is provided with a trigger lock button 25 on the handle 15 to allow the user to lock the trigger 20 in an ON or actuated position.

The tool head 16 includes a plastic threaded collar 26 which extends from the body portion 14 of the housing 13 and surrounds a blade chuck 27 which secures a screwdriver blade 30 to a rotatable motor shaft (not shown). Within the tool head 16 in a conventional power driven screwdriver, a threaded axially adjustable cylinder is normally provided for a blade depth gage, but the conventional cylinder is absent from the screwdriver assembly 11. This depth adjustment function is nonetheless provided instead by a cylinder 28 which is part of the screw supply assembly 12. The cylinder 28 threads onto the collar 26 and is thereby axially adjustable along the motor shaft.

Figures 3, 5:
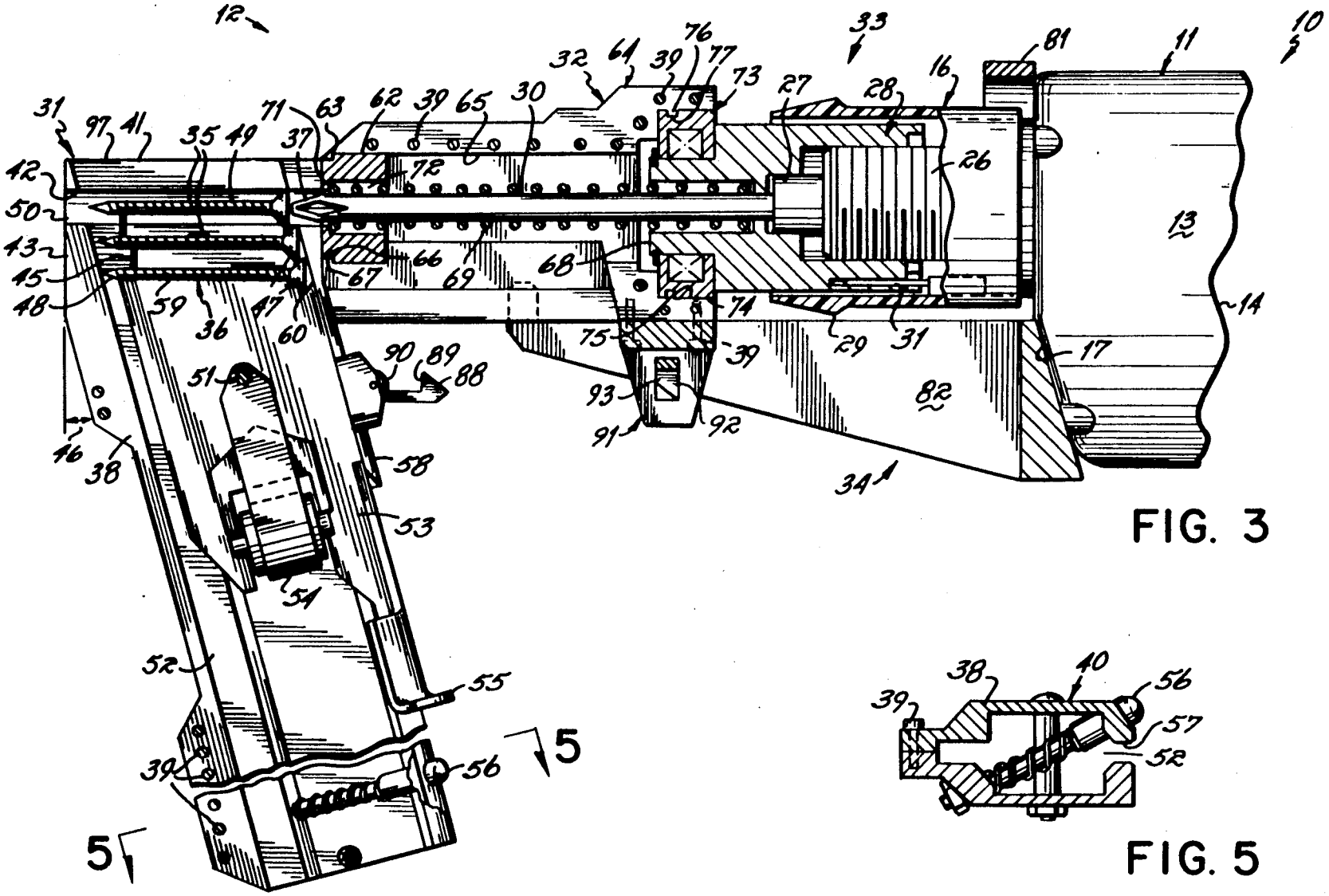
FIG. 3 is a side view, partially cut away, showing the gun of FIGS. 1 and 2, showing the feeder subassembly i extended position ready for use in collate of screws.

A plastic locking sleeve 29, which is provided on conventional screwdrivers, surrounds the tool head 16 and serves to lock the cylinder 28 against rotation in its axially adjusted position. The sleeve 29 is provided with a locking pin 21 (as shown in FIG. 3) which locks to the cylinder 28 to constrain the cylinder to rotate only with the sleeve 29. The sleeve 29 is slidable axially with respect to the housing 13 to an extended position at which it is permitted to rotate and thereby rotate and adjust axially the cylinder 28 on the collar 26 by movement on the threads of the collar 26. The sleeve 29 also slides to a retracted position against the front end 17 of the housing body 14 at which it locks to the housing body 14 and thereby locks the cylinder 28 against further rotation and axial movement.

A conventional Phillips type screwdriver blade 30 is fixedly attached to the motor shaft to rotate therewith by the chucking device 27 within the tool head 16. Built into the motor shaft is a clutch (not shown) which engages to cause the blade 30 to rotate only when the blade 30 is axially displaced inwardly toward the housing 13 by a pressing of the blade 30 against the head of a screw with force exerted at the handle 15 of the gun 10.

In general, the screwdriver assembly 11 of the gun 10 is quite similar to a hand holdable variable speed electric drill. The screwdriver assembly 11, which is the gun 10 without the screw supply assembly 12 and the modified cylinder 28, is otherwise a conventional power driven screwdriver.

The screw supply assembly 12 includes a feeder portion 31 for sequentially feeding screws to the blade 30, a slide block portion 32 for slidably supporting the feeder 31 thereon, an alignment cylinder portion 33 for rotatably supporting the slide block 32 thereon in proper axial alignment and spacing with respect to the blade 30, and a bracket assembly 34 fixedly mounted on the front end 17 of the body portion 14 of the housing 13 for locking the slide block 32 against rotational and axial movement on the screwdriver assembly 11.

The feeder 31 operates to hold a supply of drywall screws 35, preferably in the form of a collated strip 36 as illustrated in FIG. 1, and to sequentially feed the screws 35 into a position of axial alignment with the tip 37 of the blade 30 to the position illustrated in FIG. 3.

Figures 4, 4A:
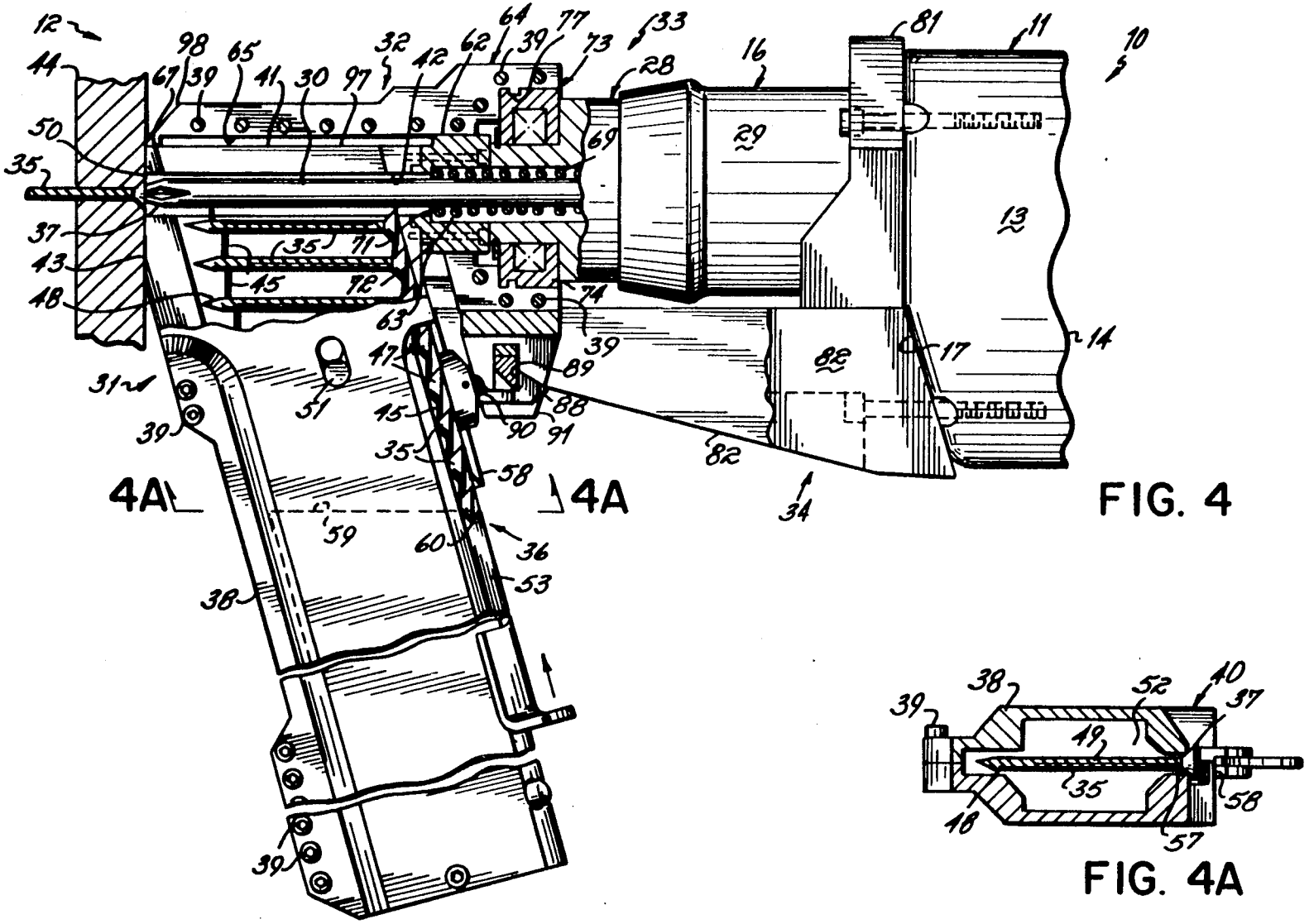
FIG. 4 is a side view, similar to FIG. 3, showing the feeder in its retracted position either at the end of the process of automatically setting a screw or as it may be used for single feed of a screw.
FIG. 4A is a cross sectional view taken along the line 4A—4A of FIG. 4.
Figure 6:
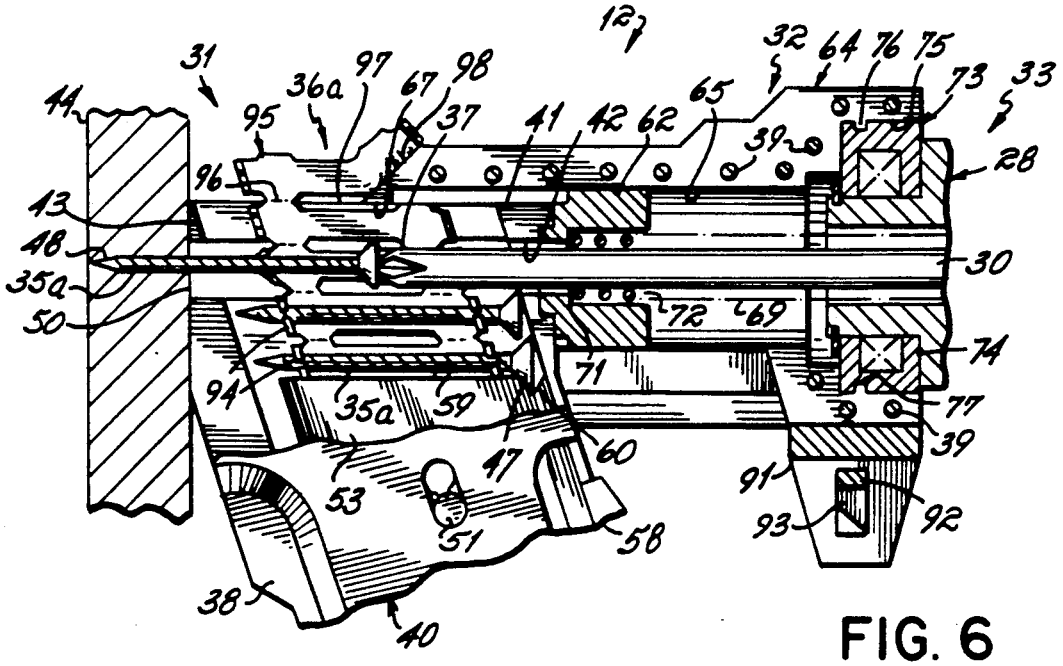
FIG. 6 is a further cut-away view of a portion of FIG. 3 and 4 with the feeder section in an intermediate position during automatic or collated screw feeding, and showing an alternative embodiment and features for collated strip configuration.

Referring to FIGS. 1-4, the feeder 31 includes a cast aluminum frame piece 38 which may be cast into a single piece, or be formed, as shown, as a pair of cast frame halves fastened together with others of the machine screws 39. The frame piece 38 has two integrally formed portions which include a magazine 40, preferably, and a barrel 41. The barrel 41 has a bore 42 therethrough which aligns axially with the blade 30 of the screwdriver assembly 11. The barrel 41 has a planar front face 43, perpendicular to the bore 42 and blade 30, so as to seat flush against the surface of a drywall panel 44 (FIGS. 4 and 6). The magazine 40 is inclined at an angle 46 of approximately 20° from the plane of the face 43.

Similarly, the web or strip 36 of drywall screws (FIG. 1) is formed such that the nails 35 are inclined at approximately 70° with the strip 36 so as to remain parallel to the blade 30 and bore 42 and to align with the blade 30 as they are fed into the bore 42. The strip 36 of screws may be formed integrally of a molded strip of plastic, with the screws joined by inter-connecting plastic strands 45 (see FIGS. 3 and 4). The screws 35 have heads 47 of the conventional Phillips-head type at an upstream end thereof, tips 48 at a downstream end thereof, and a helical threaded midportion 49 extending therebetween. The bore 42 has, at its forward end, an orifice 50 lying in the plane 43 and from which the screws 38 are driven from the bore 42 by the blade 30. The screws 38 are oriented such that, when fed into the bore 42, the heads 47 will be toward the blade 30 while the tips 48 point toward the orifice 50.

The magazine 40 has a channel 82 defined therein (FIG. 4A) within the frame 38 in which the screw strip 36 is carried. As shown in FIG. 3, the magazine 40 is provided with a slide 53 which slides in the channel and is urged upwardly by a watch type spring 54, coiled on the slide 53 with its free end connected to a wall of the magazine frame 38 near the upper end thereof by a pin 51. The upper end of the slide 53 bears against the lower end of the screw strip 36 to force the uppermost one of the screws 35 of the strip 36 into alignment with the bore 42.

The loading of the magazine 40 is accomplished by pulling the slide 53 downward in the channel 52 against the force of the spring 54 by a slide handle 55 fixed to the lower end of the slide 53 until the slide handle 55 locks at the bottom of the channel 5z by the snap action of a spring loaded detent 56 (FIGS. 3 and 5 and 5A). Then, strip 36 of screws 3S is inserted into a slot 57 at the rear of the frame 38 (FIG. 1). In doing so, the screws 35 move into the channel 52 with their tips 47 and midportions 49 within the channel 52, but with their heads 47 riding against the back of the frame 38 outside of the magazine 40 from the channel 52, where they are trapped as they move upwardly by a guide or guidewall S8 near the top of the frame 38, as better seen in FIGS. 4 and 4A. The bottom most screw 35 of the strip 36 is maintained in alignment by the top edge 59 of the slide 53 which is parallel to the axis of the blade 30. This top edge 59 of the slide 53 extends rearwardly through the slot 57 and has therein a V-shaped shaped notch 60 into which fits the head 48 of the lowermost screw 35 of the strip 36 to assist in holding the strip 36 in the channel 52.

Alternative magazine and feed structure which may be adapted for use with the present invention are shown in my U.S. Pat. No. 4,778,094 incorporated herein by reference. In addition, a strip of screws 35 may supplied in a roll carried by the operator or user of the gun 10, on his belt, for example, with the strip feeding directly and continuously into one of the feed mechanisms referred to above, or into a cog wheel or ratchet type feed at the opening at the base of the barrel 42.

The barrel portion 41 of the feeder 31 has a forward portion of a generally polygonal cross-section 61 and a rear portion 62 of cylindrical cross-section somewhat larger than that of the forward portion. The juncture of the two portions 61 and 62 of the exterior surface of the barrel 41 form a rearwardly facing step 63.

The slide block 32 is formed of a two piece aluminum casting 64 having formed therein a generally cylindrical inner bore rearward portion 65 of diameter slightly larger than that of the cylindrical rear portion of the barrel 41 so as to slidably support the barrel 41 therein. Beyond the forward end of the bore portion 65 in the casting 64 is a polygonal portion bore 66 of reduced cross-section compared with that of the cylindrical bore portion 65, and of cross-section slightly larger than that of the polygonal portion 62 of the barrel 41 so as to allow slidable movement of the forward polygonal portion 61 of the barrel 41 therein. The juncture of the two bore portions 65 and 66 provide a rearwardly facing step 67.

The barrel 41 thus slides in the bores 65 and 66 of the slide casting 64 of the magazine support assembly 32 to a forward extended position at which the surfaces 62 and 67 abut and form a stop defining the maximum extended forward position of the barrel 41 with respect to the casting 64 (see FIG. 3). The entire feeder 31 is normally biased against this stop 67 by a compression spring 69 positioned within the bore 65 so as to coil around the blade 30. The spring 69 exerts force on the feeder 31 by pressing at its forward end against the rearward facing surface 71 of the barrel 41 at the rear end of the cylindrical portion 62 thereof which is provided with a spring receiving recess 72 therein. The rearward end of the spring 69 presses against the forward facing surface 68 of the cylinder 27. This extended position of the feeder 31 and its relation to the slide block 32 is shown in FIG. 3.

The feeder 31 is slidable to a retracted position on the magazine support subassembly 32 as shown in FIG. 4. In the retracted position, the rearward facing surface 71 of the cylindrical portion 62 of the barrel 41 is defined by a stop formed in the cylinder 28 on the surface 68 (shown in FIG. 3). The sleeve 29 is adjustable axially so that the tip 37 of the blade 30 projects a predetermined distance beyond the surface 43 at the front of the barrel 41 when the subassembly 31 is at its retracted position against the stop action of the surface 68. This projection provides for precise countersinking of the heads 47 of the screws 35 into the surface of the drywall 44. The cylinder 28 is axially adjustable on the tool head 16 in the manner explained above.

The alignment assembly 33 is the primarily support by which the assemblies 11 and 12 are attached and aligned, and through which the countersinking depth setting is maintained. The alignment assembly 33 includes the cylinder 28 and a bearing assembly 73, having its inner face pressed around and fixed onto the forward end of the cylinder 28, concentric with the blade 30. The slide block 32 is mounted on the exterior of the outer ring 74 of the ball bearing 73 by assembly of the two halves of the casting 64 about the ring 74, fitting it into a recess 75 formed in the casting 64. To lock the bearing 73 into the casting 64, a raised annular locking ring 76 is machined to project from the wall of the recess 75 and into a groove 77 formed in the bearing ring 74. So assembled, the assembly 12 can not only be positively and precisely adjusted so as to provide for the proper amount of countersinking, but the entire assembly 12 self-aligns with the axis of the blade 30.

Support for the assembly 12 on the screwdriver assembly 11 is enhanced by the bracket assembly 34 which includes a yoke s1 mounted to the front end of the body 14 of the housing 13 about the top of the tool head 16, and a fork portion 82 mounted to the front end of the body 14 of the housing 13 below the tool head 16 The fork 82 has a pair of upwardly hooked prongs which fix the angular orientation of the slide block 32, preventing it from rotating or sliding axially.

Attachment of the assembly 12 to the screwdriver assembly 11 is achieved by installing the alignment assembly 33 with the cylinder 28 replacing the corresponding cylinder of a conventional power screwdriver unit, sliding the slide block 32, with the feeder 31 slidably mounted thereto, onto the bearing ring 74 of the alignment assembly 33, and attaching the bracket assembly 34. In installing the bracket assembly 34, the yoke 81 is first bolted at the existing bolt holes at the top of the tool head 16 and then the fork 82 is set in the lower holes and pivoted up such that the hooks engage and lock into position the slide block 32 (as shown in FIG. 1, to which the magazine and feed assembly 31 is already slidably attached).

The feeder 31 has, mounted on the back of the magazine 40, a spring biased hook 82 having an upper cam surface 89. The hook 88 is biased upwardly by a spring 90 (FIG. 4) to the position shown in the drawings. On the base of the casting 64 of the slide block 32 is provided a downwardly facing U-shaped bracket 91 having slidably supported therein a transverse latch pin 92. The pin 92 is square in cross-section so as not to rotate in the bracket 91, has enlarged cylindrical ends to limit its transverse movement, and has a notched center 93. The pin 92 has two positions between which it is transversely slidable in the bracket 91: a release position and a latch position. The pin 92 is so positioned as to lie in the path of the hook 88 on the magazine 40.

When the pin 92 is in the latch position (FIG. 4), the hook 88 will, as the subassembly 31 moves to the retracted position, cam downwardly upon engaging the pin 92 and then catch about the pin 92 to hold the subassembly 31 in the retracted position. When the pin is in the release position, the hook 22 will freely pass through the notch 93 permitting reciprocating motion of the subassembly 31 on the support subassembly 32. The pin 92 is bidirectionally moveable by the operator between the release and latch positions by pushing the pin to the right or left. The pin 92 is held in its respective positions by a spring loaded ball in the bracket 91 and a pair of semi-spherical notches in the pin 92. When the pin 92 is in the latch position and the feeder 31 is latched in its retracted position as shown in FIG. 4, movement of the pin 92 to the release position releases the feeder 31 and causes it to snap to its extended position as shown in FIG. 3 under the force of the spring 69.

The release position is used for the automatic feed of screws to the gun 10 while the latch position is used to lock the feed subassembly 31 in the retracted position to allow the gun 10 to be used as a conventional power screwdriver 11, for driving, tightening, or reversing and removing of individual screws.

Figure 7:
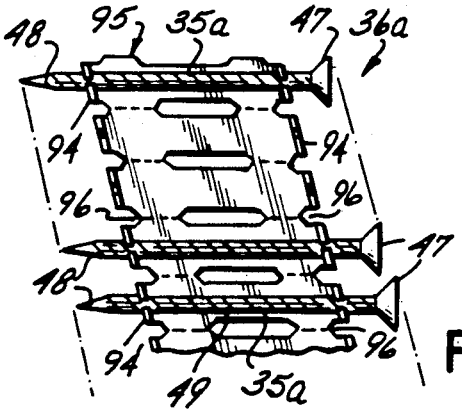
FIG. 7 is a detailed view of the collated screw strip for the embodiment of FIG. 6.
Figure 8:
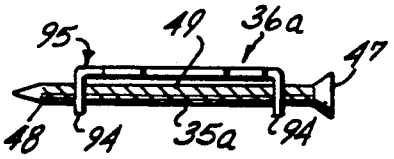
FIG. 8 is a top view of the strip of FIG. 7.

The collated screws for the gun 10 may, instead of the molded plastic strip 36 of screws 35 shown in FIGS. 1, 3 and 4 above, be metal screws such as the screws 35*a* shown in FIGS. 6–8. The screws 35*a* are formed into a strip 36*a* by being clipped into individual holder sections 94 formed in a web 95 of plastic or paper. The sections 94 are preferably each differentiated from each other by perforations 96 in the web 95. So formed, as the blade 30 advances, the screws 35*a* are separated by their forward axial movement from the web 95 as shown in FIG. 6. As the screws 35*a* are sequentially fed into the bore 42 in successive cycles of the gun 10 the spent holder sections 94 are ejected through an opening 97 in the top of the barrel 41 and cut from the web 95 along the perforation line 96 by a blunt knife edge 98, formed by a taper of about 20°, at the front edge of the top of the casting 64 as the feeder 31 slides rearwardly in the slide block 32.

In operation, after loading the magazine 40 with a strip 36 of screws 35, the operator would slide the magazine release pin 92 to the release position which would cause the feeder 31 to slide forward in the slide block 32 until the abutment 63 engages the surface 67. This is the position shown in FIG. 3. At that point, the slide 53 in the magazine will advance the strip 36 upwardly in the channel 5z of the magazine 40 so that one of the screws 35 is in alignment with the blade 30 in the bore 42 of the barrel 41. Then the operator may activate the trigger 20 to turn on the motor 18 and press the gun 10 by the handle 15 to force the surface 43 of the barrel 41 against the surface of the drywall 44.

As the gun 10 is pressed against the drywall 44, the tip 37 of the blade 30 begins engaging the head 47 of the screw 35 which is in the bore 42 of the barrel 41 to begin to move the tip 42 of the screw against and into the drywall 44, as is, for example, shown in FIG. 6. As this position is reached, the blade 30 is pressed toward the motor shaft, engaging the clutch which causes the blade 30 to turn clockwise with the motor 18. This motion drives the screw into the drywall 44 to the position shown in FIG. 4. The screw head 47 will be generally driven into the drywall to a depth determined by the adjustment of the cylinder 28 of the alignment assembly 33. When the screw is properly set, the operator may release the trigger 20, but will nonetheless remove the gun 10 from contact with the surface of the drywall 44. This releases the inward force on the blade 30, releasing the clutch in the motor shaft and stopping the rotation of the blade 30. It also allows the feeder 31 to slide forward to the position of FIG. 3, allowing another screw 35 to feed into the bore 42 of the barrel 41.

In the alternative, the feeder 31 may be provided without a screw supply carried by a magazine 40 supported on the gun 10. Instead, it may be desirable for the operator to carry a coiled web of screws on his person, such as on a belt suspending them from the operator's waist, or to use a supply of screws in a flexible strip from a container on the floor. Such a strip would be sufficiently strong to support the anticipated weight of the screws and overall tension of the strip 36. Such an embodiment is shown, for example, in FIG. 9.

Figure 9:
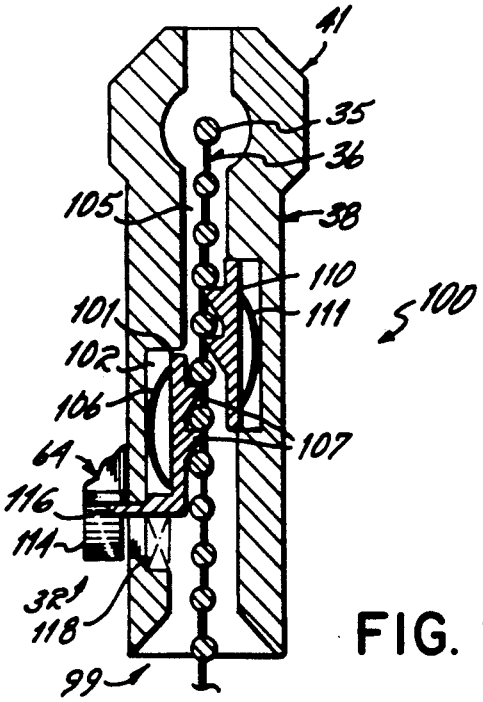
FIG. 9 is a cross-sectional diagram of the screw strip feeder portion of an alternative embodiment of the invention.

Referring to FIG. 9, the strip 36 enters directly into an opening at the bottom of a guide slot 99 formed of a short version of the frame 38 extending downward about 2 inches from the bottom of the barrel 41, past a feeder mechanism 100. The feeder mechanism 100 may, in such a case, be any of several simple types such as a cog wheel type or and a type of reciprocal ratchet feeder as shown in FIG. 9.

As shown in FIG. 9, the feeding mechanism 100 includes a multiple fingered feed ratchet 101 which is mounted on the frame 38 to one side of the path of the screw strip 36 so as to slide vertically in a slot 102 in the frame 38 a distance at least equal to the spacing of the screws 35 on the strip 36 The feed ratchet 101 is moveable transversely into and out of the path of the strip 36 as it feeds into Opening 105 in the base of the barrel 41, but is biased by a spring 106 toward the strip 36. Teeth 107 on the ratchet 101 have upper horizontal surfaces and lower tapered surfaces so as to advance the strip upward a distance equal to the spacing of the screws 35 whenever the feed ratchet 101 is advanced upwardly in the slot 102, and to shift transversely against the spring 106 out of the feed path and to step past the screws 35 when the retracted downwardly.

On the opposite side of the strip 36 from the feed ratchet 101 on the frame 38 is a holding ratchet 110, vertically fixed but transversely moveable, mounted to the frame 38 so as to move out of the path of the strip 36 as the strip is advanced upwardly toward the barrel 41. The holding ratchet 110 is biased toward the strip 36 by a spring 111 so as to hold the screws 35 from slipping downwardly as the feed ratchet 101 is being retracted.

The retraction of the feed ratchet 11 is achieved by a cocking lever, cam or (as shown in FIG. 9) a wedge 114 positioned so as to engage a follower 116 on the feed ratchet 101 in response to the movement of the feeder 31 with respect to the slide block 32. The wedge 114 may be fixed to the casting 64 of the slide block 32 to contact and move the follower 116 downward as the feeder 31 retracts, to move the feed ratchet 101 downward, cocking the ratchet 101 to the next screw 35 on the strip 36.

Specifically, as the relative positions of the feeder 31 and slide 32 are approaching the position shown in FIG. 4, a return spring 118, which is maintained in compression between the feed ratchet 101 and the frame 38, provides the force which urges the feed ratchet 101 upwardly to feed the strip 36 so as to bring the next screw 35 into the barrel 41 when the feeder 31 approaches its extended position of FIG. 3, after the wedge 114 has been withdrawn and the blade 30 clears the path of the next screw 35 being fed into the bore 42 of the barrel 41.

Instead of the wedge 114, other conventional linkage may be provided carrying a cocking lever or cam and mounted on the frame 38 of the feeder 31. The linkage may be actuated by a cam follower at its inner end which is driven by a cam on the casting 64.

Having described the invention in the context of illustrated and preferred embodiments, those skilled in the art will appreciate that variations may be made without departing from the concepts of the invention.

Accordingly, the following is claimed:

1. A power screwdriver comprising:

a screwdriver gun having a housing, a handle fixed to said housing, a screwdriver blade rotatably supported on and extending from said housing with a screwhead-engaging tip at the remote end thereof, and a motor carried by said housing and having a rotary output drivably connectable to said blade;

a screw feeder including a barrel having a bore therethrough terminating in an orifice at one end of said barrel;

means for supporting said feeder on said housing with said bore in axial alignment with said blade with the orifice remote from said housing; means for slidably supporting said barrel for axial movement with respect to said blade between a retracted position wherein the tip of said blade extends through said bore at least to the orifice, and an extended position wherein the tip of said blade is spaced from said orifice;

said feeder including means for sequentially feeding a plurality of screws, each having a head at one end thereof, into said barrel, including means for feeding one of said plurality of screws into said bore between the orifice and the tip of said blade when said barrel is in its extended position with the tip of the screw toward the orifice and the head toward said blade; and, operator actuatable means for selectively latching said barrel against movement with respect to said blade in said retracted position.

2. The screwdriver of claim 1 wherein said feeder supporting means includes means for axially adjusting the position, when said barrel is in its extended position, of the tip of said blade with respect to said orifice.

3. The screwdriver of claim 2 wherein said blade extends through said bore beyond said orifice when said barrel is in said extended position with respect to said blade.

4. The screwdriver of claim 1 wherein said latching means latches said barrel in the retracted position with respect to said blade with the tip of said blade extending through said bore beyond said orifice, whereby said screwdriver, when operated with said barrel latched in said retracted position, will engage and drive a screw with the top of said blade for alternative use in single screw and manually fed applications.

5. The screwdriver of claim 4 wherein said motor is a variable speed reversible electric motor and is selectively operable when said barrel is latched in said retracted position to engage and to selectively reversibly drive a screw with the tip of said blade.

6. The screwdriver of claim 1 wherein said motor is a variable speed reversible electric motor.

7. The screwdriver of claim 1 wherein said screw feeding means includes means for simultaneously advancing a plurality of screws of a connected strip of screws toward said barrel when said barrel is in its extended position.

8. The screwdriver of claim 1 wherein said screwdriver gun includes a clutch connected between said motor and said blade for selectively drivably connecting said motor output to said blade in response to compressive force exerted on said blade and for releasing said motor from said blade in absence of such force.

9. A power screwdriver comprising:

a screwdriver gun having a housing, a handle fixed to said housing, a screwdriver blade rotatably supported on and extending from said housing with a screw head engaging tip at the remote end thereof, and a motor carried by said housing and having a rotary output drivably connectable to said blade;

a screw feeder including a barrel having a bore therethrough terminating in an orifice at one end of said barrel;

means for supporting said feeder rotatably about the axis of said blade on said housing with said bore in axial alignment with said blade with the orifice remote from said housing;

said feeder supporting means having means connected thereto for slidably supporting said barrel thereon for axial movement with respect to said housing between a retracted position toward said housing in which the tip of said blade extends through said bore at least to the orifice, and an extended position away from said housing where the tip of said blade is spaced from said orifice;

said feed including means for sequentially feeding a plurality of screws, each having a head at one end thereof, into said barrel, including means for feeding one of said plurality of screws into said bore between the orifice and the tip of said blade when said barrel is in its extended position with the tip of the fed screw toward the orifice and the head toward said blade;

means for latching said barrel in its retracted position with the tip of said blade extending through said bore at least to the orifice, said screwdriver being operable when said barrel is so latched to engage and drive a screw with the tip of said blade;

said feeder supporting means including means for axially adjusting the position, when said barrel is in its extended position, of the tip of said blade with respect to said orifice; and means fixed to said housing for locking said feeder against rotation on said housing.

10. The screwdriver of claim 9 wherein said motor is a variable speed reversible electric motor.

11. The screwdriver of claim 9 wherein said screw feeding means includes means for simultaneously advancing a plurality of screws interconnected in a strip toward said barrel when said barrel, with one screw being fed into said bore each time said barrel moves to the extended position.

12. The screwdriver of claim 9 wherein said screwdriver gun includes a clutch connected between said motor and said blade for selectively drivably connecting said motor output to said blade in response to compressive force exerted on said blade and for releasing said motor from said blade in absence of such force.

13. A power screwdriver comprising:

a screwdriver gun having a housing, a handle fixed to said housing, a screwdriver blade rotatably supported on and extending from said housing with a screwhead-engaging tip at the remote end thereof, and a motor carried by said housing and having a rotary output drivably connectable to said blade;

a screw feeder including a barrel having a bore therethrough terminating in an orifice at one end of said barrel and an opening in a side thereof for receiving screws therethrough;

means for supporting said feeder on said housing with said bore in axial alignment with said blade with the orifice remote from said housing;

means for slidably supporting said barrel for axial movement with respect to said blade between a retracted position wherein the tip of said blade extends through said bore at least to the orifice, and an extended position wherein the tip of said blade is spaced from said orifice;

means fixed to said barrel adjacent said opening for feeding an interconnected strip of screws, including detachably interconnected sections of interconnecting material, through said opening and into said barrel into axial alignment with said blade from a supply while allowing the position of said supply to be maintained independent of the motion of said blade relative to said barrel;

said feeding means including means for feeding one of said plurality of screws into said bore between the orifice and the tip of said blade when said barrel is in its extended position with the tip of the screw toward the orifice and the head thereof toward said blade; and cut-off means including an edge formed on said barrel support means and positioned in cooperating relationship with an edge formed on structure fixed to said barrel for separating said sections from said strip.

14. The screwdriver of claim 13 further comprising:

a magazine fixedly attached to said barrel adjacent said opening for supplying a strip of screws thereto.

15. The screwdriver of claim 13 further comprising:

a guide adjacent said opening for receiving a flexible strip of screws therethrough, said guide having mounted thereon said feeding means.

16. The screwdriver of claim 13 wherein said screws are detachably connected to said strip and said blade is operable in cooperation with said barrel to separate a screw in said bore from said strip when said barrel is moved relative to said housing from the extended to the retracted position.

17. The screwdriver of claim 16 wherein said screwdriver gun includes a clutch connected between said motor and said blade for selectively drivably connecting said motor output to said blade in response to compressive force exerted on said blade.

* * * * *

UNITED STATES PATENT AND TRADEMARK OFFICE

CERTIFICATE OF CORRECTION

PATENT NO. : 5,101,697

DATED : April 7, 1992

INVENTOR(S) : Gary M. Fishback

It is certified that error appears in the above-identified patent and that said Letters Patent is hereby corrected as shown below:

Col. 4, line 33, "i" should be --in its--

Col. 4, line 33, "collate" should be --collated feed--

Col. 4, line 54, "lo" should be --10--

Col. 4, line 66, "6" should be --16--

Col. 5, line 1, "is" should be --18--

Col. 6, line 36, "38" should be --35--

Col. 6, line 37, "38" should be --35--

Col. 6, line 40, "82" should be --52--

Col. 6, line 55, "5z" should be --52--

Col. 6, line 57, "3$" should be --35--

Col. 6, line 64, "$8" should be --58--

Col. 8, line 17, "sl" should be --81--

Col. 8, line 40, "82" should be --88--

Col. 9, line 34, "5z" should be --52--

Col. 9, line 44, "42" should be --48--

UNITED STATES PATENT AND TRADEMARK OFFICE

CERTIFICATE OF CORRECTION

PATENT NO. : 5,101,697

DATED : April 7, 1992

INVENTOR(S) : Gary M. Fishback

It is certified that error appears in the above-identified patent and that said Letters Patent is hereby corrected as shown below:

Col. 10, line 35, "11" should be --101--

Col. 11, line 42, "top" should be --tip--

Col. 12, line 16, "feed" should be --feeder--

Signed and Sealed this

Twelfth Day of October, 1993

Bruce Lehman

*Attest:*

BRUCE LEHMAN

*Attesting Officer*

*Commissioner of Patents and Trademarks*